United States Patent [19]

Humbert

[11] Patent Number: 4,987,701

[45] Date of Patent: Jan. 29, 1991

[54] ENDLESS BELT VALVE GRINDER

[75] Inventor: Marvin H. Humbert, Aberdeen, S. Dak.

[73] Assignee: K. O. Lee Company, Aberdeen, S. Dak.

[21] Appl. No.: 181,982

[22] Filed: Apr. 15, 1988

[51] Int. Cl.[5] ..... B24B 15/04; B24B 21/02

[52] U.S. Cl. ..... 51/145 R; 51/105 VG; 51/217 T; 51/237 R

[58] Field of Search ..... 51/145 R, 144, 105 VG, 51/105 R, 289 R, 217 T, 237 R

[56] References Cited

U.S. PATENT DOCUMENTS

| | | | |
|---|---|---|---|
| 2,113,387 | 4/1938 | Silven | 51/105 VG |
| 2,120,198 | 6/1938 | Blazek | 51/105 VG |
| 2,127,748 | 8/1938 | Miller | 51/105 VG |
| 2,136,188 | 11/1938 | Gagne | 51/105 VG |
| 2,413,678 | 1/1947 | Beverlin | 51/237 R |
| 2,606,767 | 8/1952 | Preston | 51/105 VG |
| 2,778,163 | 1/1957 | Flygere | 51/105 VG |
| 2,802,310 | 8/1957 | Chaplik | 51/135 |
| 4,590,711 | 5/1986 | Sollami | 51/3 |
| 4,662,116 | 5/1987 | Erani | 51/3 |

OTHER PUBLICATIONS

Standard Valve Refacer (K403 Series), 3/87, pp. 1 and 2.

Heavy Duty Valve Refacer Bulletin No. HDV-87 (Model No. 500HM2) 9/87, pp. 1-4.

*Primary Examiner*—Robert A. Rose

*Attorney, Agent, or Firm*—Dorsey & Whitney

[57] ABSTRACT

An endless belt valve grinder for refacing valve heads used in internal combustion engines. Grinding is done by rotating the valve face against a moving endless abrasive belt supported on a backing wheel and driven by a driving wheel. The workhead or chuck assembly for holding the valve during grinding is automatically pneumatically actuated for gripping and releasing the valve stem. Air pressure is selected and regulated and a stop is provided to adjust the gripping force on the valve stem.

11 Claims, 4 Drawing Sheets

ENDLESS BELT VALVE GRINDER

BACKGROUND OF THE INVENTION

1. Field

The invention is a grinding apparatus for refacing frusto-conical valve faces, such as those on the valve heads of internal combustion engine valves in passenger vehicles and trucks, in the range of three-fourths to four inches head diameter.

2. Related Art

Grinding of internal combustion engine valve faces has long been a procedure in reconditioning engines such as those in passenger vehicles and trucks. Traditionally, apparatus for valve face grinding or resurfacing has included a grinding wheel with an abrasive cylindrical grinding surface and a workhead for mounting or holding the valve by its stem. The workhead has been manually actuated to grip and release the valve stem of the valve to be ground. Such apparatus is disclosed in the U.S. Pat. No. to Gagne et al. - 2,136,188. Such apparatus has been made and sold in the U.S. by K.O. Lee Company, Aberdeen, S. Dak., the assignee of the present invention, designated as valve refacers, Model Nos. K 403 Series and Model K 500 HM2 (heavy duty).

Such devices require frequent dressing of the grinding wheel, such as dressing after grinding fifteen to twenty valves, and significant time is also required to manually release a ground or refaced valve and insert and grip an unground valve. These time requirements become increasingly significant as the number of valves to be ground increases.

Other patents, not in the valve grinding art, such as the U.S. Pat. No. to Chaplik - 2,802,310, disclose grinding a hypodermic needle point which is gripped by manual clamping in a work head, and moved into grinding engagement with an endless abrasive belt. In Chaplik there is no need for or disclosure of any means for rotating the hypodermic needle point against the endless belt, which would be counter-productive in that a sharp point would be ground away by rotation of the needle, and there is no teaching of an automatically actuated gripping and/or release mechanism for gripping and releasing the needle in the workhead.

The U.S. Pat. No. to Erani - 4,662,116 teaches the substitution or interchangeability of an endless belt grinder for a grinding wheel or disc. Erani does not, however, teach any work head mechanism for mounting and rotating the work piece, such as a valve stem and head, as does the present invention.

Neither Chaplik, nor Erani could be used to grind or reface the frusto-conical valve face of valves used in internal combustion engines.

SUMMARY OF THE INVENTION

The present invention considerably increases the number of valves that can be ground without dressing or changing the grinding wheel by providing an abrasive grinding belt with a considerably increased continuously available grinding surface, as compared to a grinding wheel with comparable space requirements. In addition, pneumatically actuated means is provided to quickly and efficiently release ground valves and grip unground valves in the work head, vastly increasing the number of valves that can be ground per unit time. This, of course, greatly reduces the cost of valve grinding.

More specifically features of the present invention include:

1. The ability to reface two (2) valves per minute,
2. The ability to reface 200 to 500 valves per belt, per dressing,
3. Changing and conditioning (dressing) the grinding belt or surface in two to two and one-half minutes,
4. Abrasive cost (grinding wheels compared to belts) of about 50% to 35% of the cost of conventional grinding wheels,
5. Only a small amount of abrasive is introduced into the grinding oil as compared to conventional grinding methods. This means greatly extended machine life because of the low amount of suspended abrasives carried to and around the moving parts of the workhead by the grinding oil,
6. The invention allows plunge grinding without damage to abrasive and workhead components,
7. The endless belt is equivalent to a 14" diameter grinding wheel in abrasive surface available, and
8. The invention provides an infinitely variable valve stem clamping force.

DESCRIPTION OF THE DRAWINGS

FIG. 2 shows a valve member mounted or gripped in the workhead with the valve face to be ground in grinding engagement with the endless abrasive belt.

DESCRIPTION OF THE PREFERRED EMBODIMENT

General and Major Component Description

Figure 1:
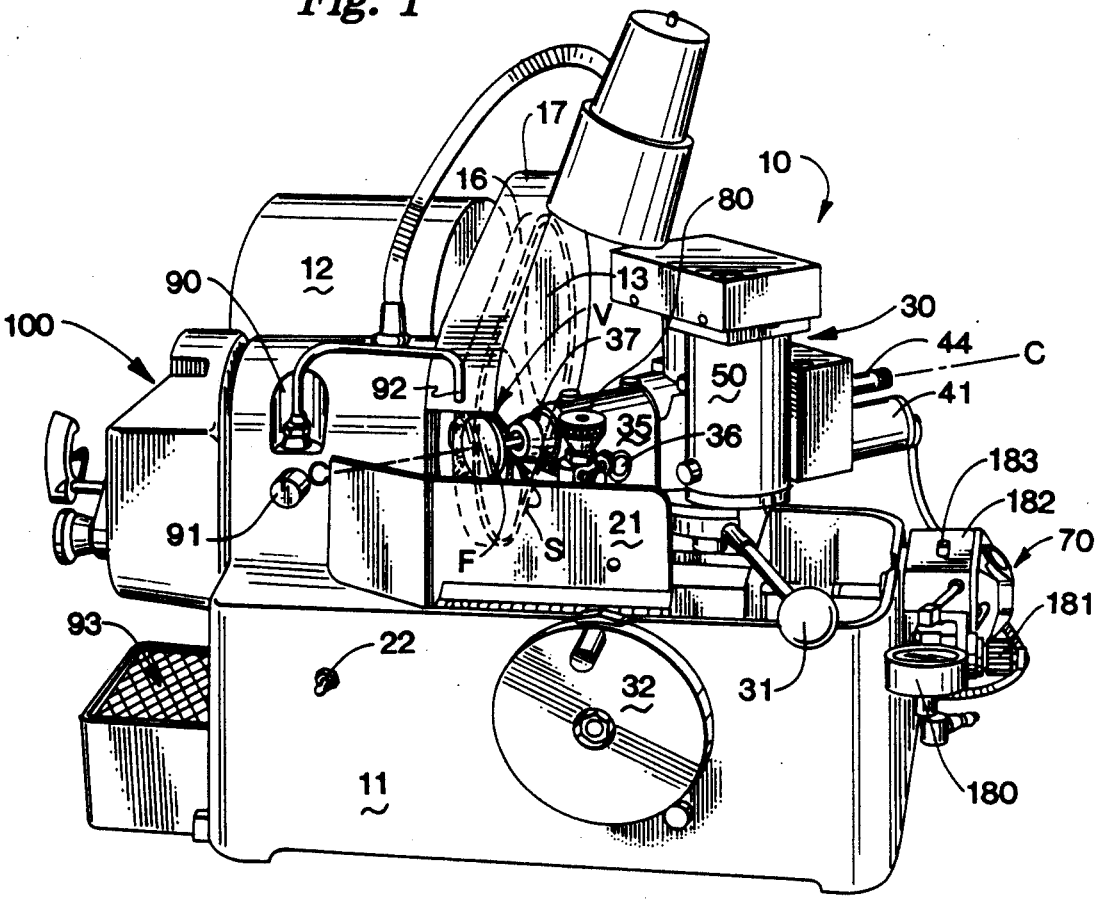
FIG. 1 is a perspective view of the valve grinding apparatus of the present invention and shows the general layout and major components of the complete invention.
Figure 2:
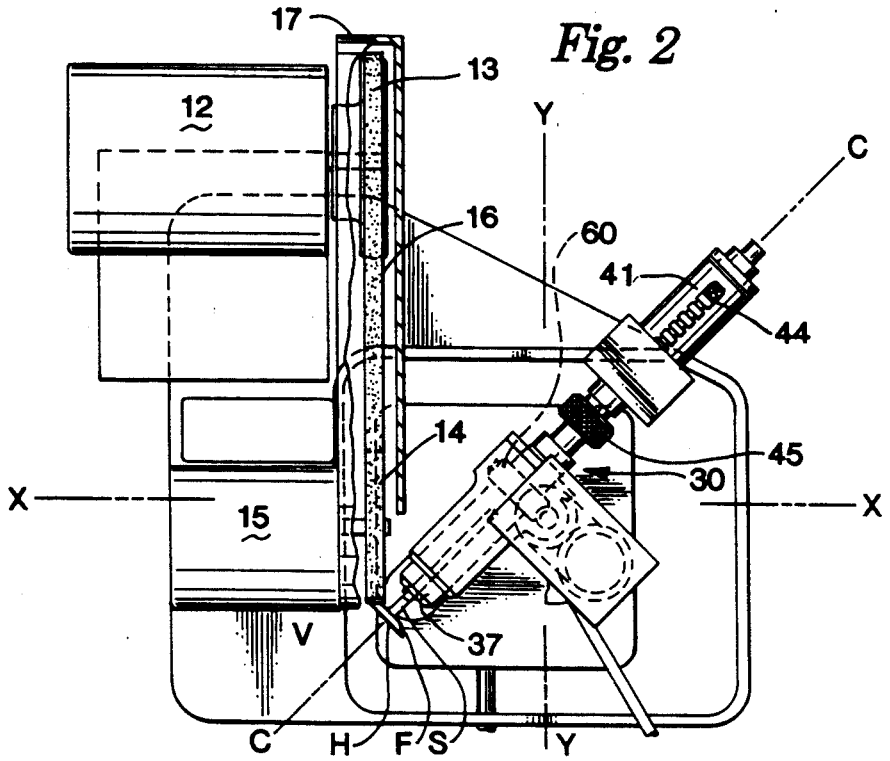
FIG. 2 is a simplified top view of the grinding components, including the endless abrasive belt and the workhead of chuck assembly components of the invention.

The general layout and major components of the preferred embodiment of the invention are shown in FIGS. 1 and 2. With reference to FIG. 1, the work or valve, which the invention 10 is designed to grind, is shown at V and includes a valve head, H, a valve stem, S, and a frusto-conical valve face, F.

The major components include, with reference to FIGS. 1 and 2, a base 11, an endless abrasive belt drive motor 12, a drive wheel 13 mounted for rotation about a first axis, a backing wheel 14 mounted for rotation about a second axis, a backing wheel bearing 15 and an endless abrasive belt 16. A shroud 17 covers the major portion of the drive wheel 13, backing wheel 14 and endless belt 16. Endless belt 16 extends around the generally cylindrical surface of drive wheel 13 and backing wheel 14 and is driven by drive wheel 13.

A lamp 20 is provided to illuminate the work or valve head at the grinding interface between valve face, F, and endless belt 16, and a shield 21 protects the operator from ground fragments, abrasive and grinding oil during operation. An on-off switch 22 serves to switch electrical power to the main drive motor 12 and the other electrical motors and devices used in the invention.

A workhead or chuck assembly 30 serves as a means for mounting or gripping the work or valve, V, during the grinding operation. Chuck assembly 30 is mounted for left to right movement along horizontal axis, X, shown in FIG. 2, by manual left to right movement of knob 31. Chuck assembly 30 is mounted for forward and back movement along horizontal axis, Y, shown in FIG. 2, by manual turning of wheel 32. Chuck assembly 30 is also mounted for pivotal movement about a vertical axis, Z, shown in FIGS. 3 and 4, by manual pivoting. These movements along axes X, Y and Z are conventional workhead movements accomplished by conventional means, to move the work or valve, V, into and out of grinding engagement with belt 16, and to set the angle of the axis of chuck assembly 30 with relation to the grinding axis to accommodate various frusto-conical valve face angles.

Figure 3:
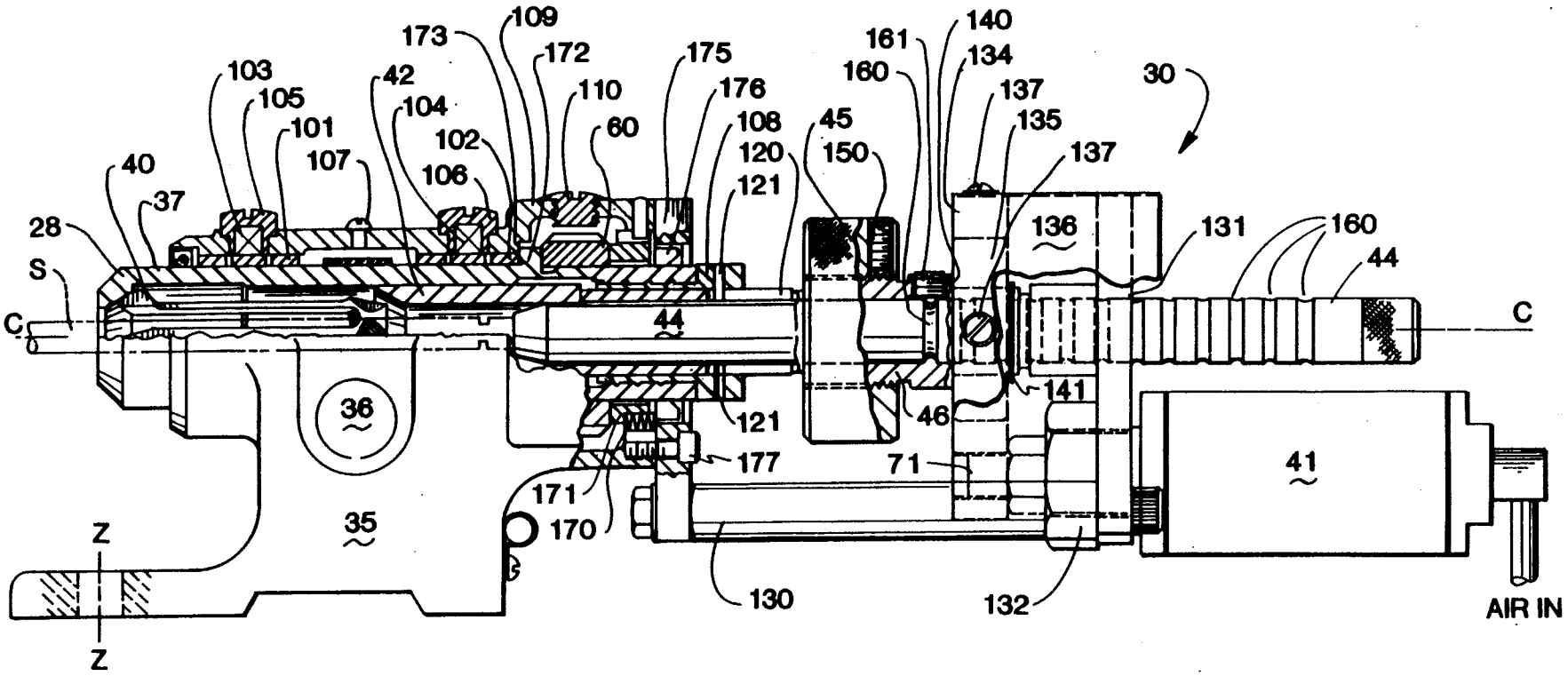
FIG. 3 is a side view of the workhead or chuck assembly with some parts cut away and shows the chuck assembly in the retracted or released position for releasing or removing a ground valve and inserting a new valve to be ground. The means for rotating the valve during grinding not shown in FIG. 3.
Figure 4:
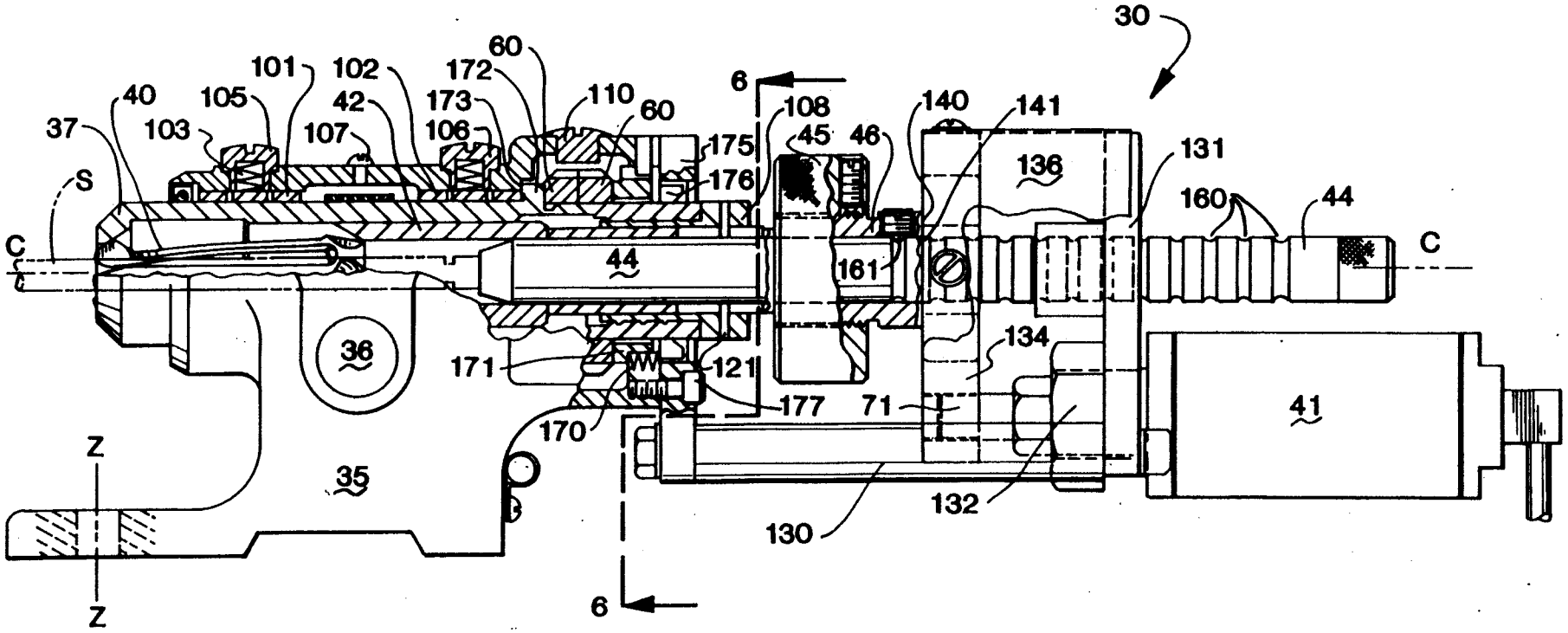
FIG. 4 is a side view of the workhead or chuck assembly like FIG. 3, but shows the chuck assembly in an intermediate position as when moving from the retracted or released position of FIG. 3 to the fully closed or valve stem gripping position. Like FIG. 3, the means for rotating the valve stem and head during grinding is not shown in FIG. 4.
Figure 5:
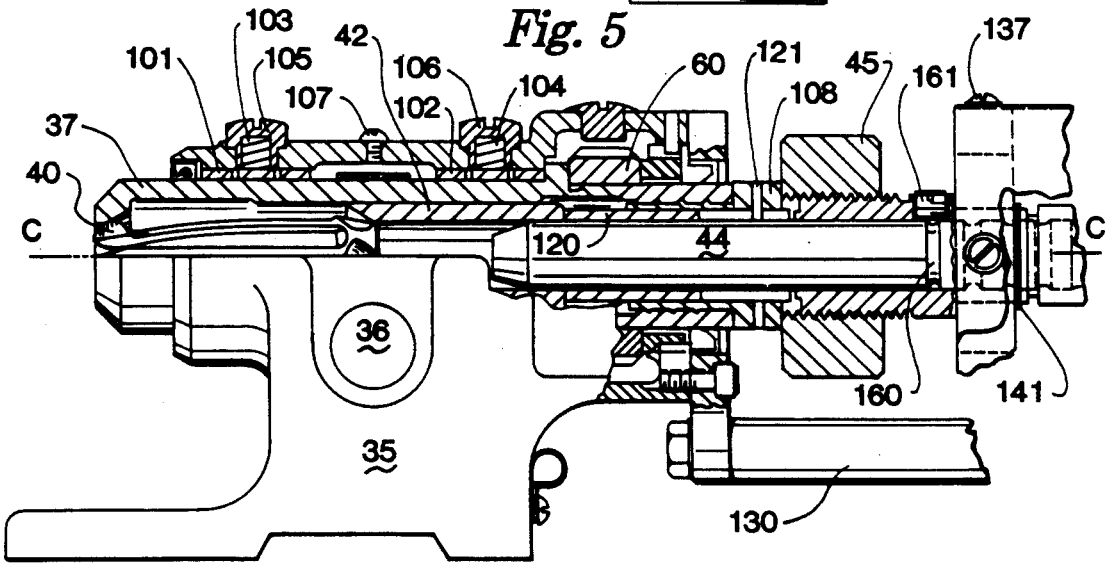
FIG. 5 is a partial side view of the workhead or chuck assembly shown in FIGS. 3 and 4, with the chuck assembly in the fully closed or valve stem gripping position.

Other major components of the chuck assembly 30 include a chuck assembly mounting head 35, which includes a lubricating oil level sight window 36, shown in FIGS. 3–5, and a chuck spindle 37 mounted for rotation in mounting head 35 about the axis, C, of the chuck assembly 30, shown in FIGS. 1–5. A collet 40, best seen in FIGS. 3–5, serves to grip valve stem, S, and pneumatic cylinder 41 serves to move collet actuating sleeve 42 into engagement with collet 40 to close collet 40 into gripping engagement with valve stem, S, through specific mechanism described in detail below.

A valve stem stop pin 44, co-axially mounted on axis, C, is adjustable along axis C, relative to spindle 37, to adjust the seated relationship of valve stem, S, in collet 40 and spindle 37 to accommodate various valve stem lengths. Adjusting nut or stop 45 can be moved along sleeve 46 to adjust the stopping or "bottoming out" position, shown in FIG. 5, of nut 45, sleeve 46 and collet sleeve 42, thereby controlling the maximum gripping force of collet 40 on valve stem, S.

Figure 6:
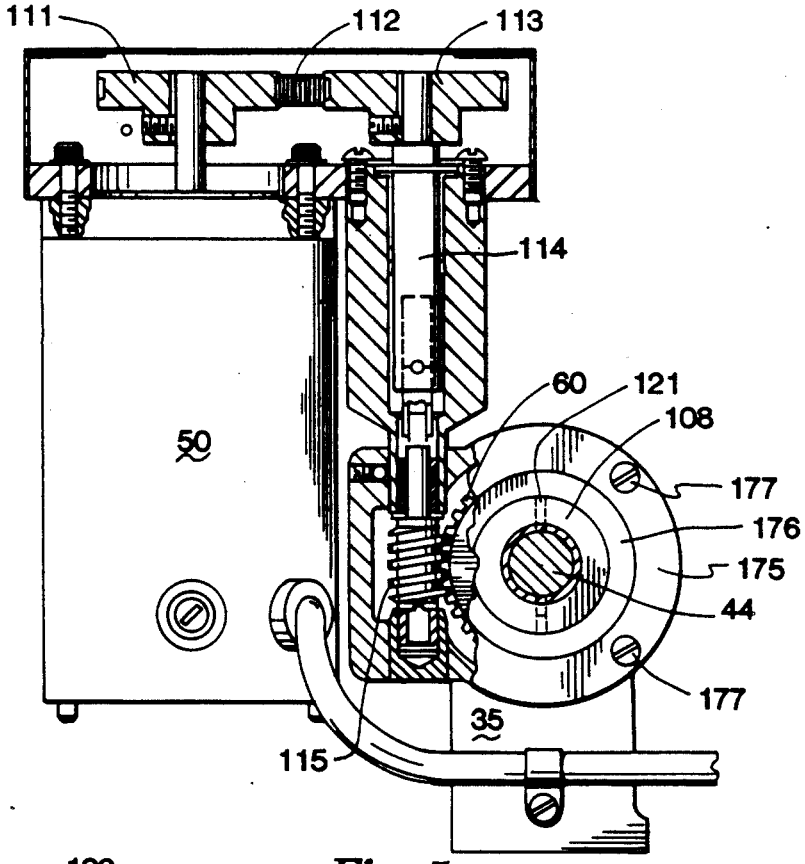
FIG. 6 is a vertical sectional view taken on the line 6—6 of FIG. 4, and shows the means for rotating the valve stem during grinding (omitted from FIGS. 3 and 4), and a section of the workhead or chuck assembly shown in FIGS. 3–5.

A work or valve rotation drive motor 50, shown in FIGS. 1 and 6, drives spindle drive gear 60 to rotate spindle 36 about axis, C, at the rate of 10–200 rpm, thus rotating the valve face, F, against endless belt 16 during the grinding process.

A pressure actuating valve, switch and regulator unit 70, shown in FIG. 1, conducts and vents air pressure at regulated pressures to pneumatic cylinder 41, for automatically gripping valve stem, S, in chuck assembly 30, and for infinitely adjusting the gripping force of collet 40 on valve stem, S, by varying the air pressure. Unit 70 also vents cylinder 41 to allow the return spring (not shown) to retract the cylinder and actuating rod 71, thereby releasing valve stem, S, from the gripped portion in collet 40.

Other conventional major components shown in FIG. 1 include a rocker arm workhead attachment 80, a grinding oil circulation, filtering and cooling system 90, which includes a circulating pump (not shown) a shut-off valve 91, grinding oil stem 92 and cooling reservoir 93. The embodiment of FIG. 1 also includes a valve stem butt grinding attachment 100.

Sub-Assembly Description

The endless belt mounting and driving means is shown in FIGS. 1 and 2 and is designed to provide a lineal speed of the abrasive grinding belt 16 in the range of 6000–7500 feet per minute. To achieve this speed drive motor 12 consists of a one horse power, A.C. motor with an output shaft speed of 3450 rpm. Drive wheel 13 has an outside diameter of about 6 and 9/16 inches and backing wheel 14 has an outside diameter of 5 and ⅛". Drive wheel 13 and backing wheel 14 are provided with truncated, crowned belt-engaging surfaces (not shown) and are aligned and spaced on parallel first and second axes, respectively, for mounting a 44 " abrasive belt which engages and extends around the crowned generally cylindrical surfaces of drive wheel 13 and backing wheel 14. Rotation of drive wheel 13 thus drives abrasive grinding belt 16.

A suitable abrasive endless belt 16 is one sold by the Norton Company, Worcester, Mass., specified as a ⅝"×44" SAABA with abrasive Z100X, NORZON, E823 standard.

The details of the workhead or chuck assembly 30 are best understood with reference to FIGS. 3–6. Chuck assembly 30 includes a main mounting head 35, a chuck spindle 37 rotationally mounted in the mounting head 35, and drive means explained below for rotating chuck spindle 37 about the longitudinal axis, C, of the assembly.

Mounting head 35 is pivotally mounted to base 11 of valve grinder 10 by conventional means (not shown) for selective, manual pivotal movement about vertical axis, Z, shown in FIGS. 3 and 4, to position valve, V, with respect to belt 16 to accommodate various valve face angles, including settings for 45°, 30°, 20°, 15° and 90°.

Chuck spindle 37 has a beveled end 38 which accommodates collet 40. A drive gear 60 is keyed to spindle 36 to rotate spindle 36 in bearings 101 and 102 which are spring loaded with springs 103 and 104 in caps 105 and 106, respectively. An oil port 107 is provided for lubricating spindle 37 for rotation. Threaded sleeve and cap 108 is threaded in the right end of spindle 37, as shown in FIGS. 3 and 4. Mounting head 35 includes a drive gear housing 109 and cap 110 for access to the oil bath for lubricating gear 60. Rotation of gear 60 rotates spindle 37, collet 40 and threaded sleeve and cap 108.

Drive gear 60 is driven to rotate spindle 37 in the range of 10–200 rpm by spindle motor 50, pulley 111, belt 112, pulley 113, shaft 114 and worm gear 115 shown in FIG. 6, all mounted on mounting head 35. Motor 50 is a 1/15 horsepower, D.C. motor with an output shaft speed of 3000 rpm.

Valve stem, S, is gripped in spindle 36 by collet 40. Valve stem, S, is positioned for gripping by valve stem stop pin 44 and gripped by the actuation of pneumatic cylinder 41 operating on collet sleeve 42 through slotted sleeve 120, which is co-axially mounted in threaded sleeve and cap 108 and spindle 37, and pinned for longitudinal but not rotational movement with respect to spindle 37 by pins 121.

The actuation of cylinder 41 operates on slotted sleeve 120 because cylinder 41 is mounted to mounting head 35 by a pair of tie bars 130, cantilevered from mounting head 35, which also mount rectangular guide plate 131, which has a bore to accommodate stop pin 44. Cylinder 41 is mounted to plate 131 by nut 132 so that cylinder 41 and guide plate 131 are cantilevered from and fixed with respect to mounting head 35. Cylinder actuating rod 71 is fixed to bearing carrier plate 134, which accommodates ball bearings (not shown) at location 135, the inner race of which rotates with spindle 37 and stop pin 44, and the outer race of which is fixed in plate 134. Stroke movement of actuating rod 71 of cylinder 41 thus causes plate 134 to move to the left along axis, C, pushing against shoulder 140 at the right end of slotted sleeve 120, as shown in FIG. 3, to compress collet 40, through compressive force transmitted through slotted sleeve 120 and collet sleeve 42, on valve stem, S, when actuated with air pressure. When air pressure is vented from cylinder 41, slotted sleeve 120 is pulled to the right as plate 134 is moved to the right, and engages retainer ring 141 fixed to slotted sleeve 120, under the influence of the return spring in cylinder 41. Valve stem stop pin 44 moves with plate 134 along axis, C.

Such pneumatic actuation of cylinder 41 and actuating rod 71, which moves plate 134 along axis, C, causes collet 40 to grip the valve stem, S, by compression against the right end of slotted sleeve 120, as shown in FIG. 3, thereby moving slotted sleeve 120 from the retracted position in FIG. 3, through the intermediate position of FIG. 4 and to the closed position of FIG. 5. Slotted sleeve 120 is compressed against collet sleeve 42, the centering conical end of which compresses the right end of collet 40 against valve stem, S. Simultaneously the left end of collet 40 is pressed against the beveled end 38 of spindle 37 and into gripping engagement with valve stem, S. Valve stem, S, is therefore gripped at both ends of collet 40. The gripping points of collet 40 on valve stem, S, are angularly spaced at alternating 60° angles at the left and right ends of collet 40.

The air pressure in cylinder 41 can be regulated and chosen to vary the gripping force on valve stem, S.

The pneumatic compressive stroke of cylinder 41 can be limited by selectively positioning the large, knurled adjusting nut 45, which is threaded onto sleeve 120. Nut 45 abutts or "bottoms-out" on the cap end of threaded sleeve end cap 108 at various stroke lengths of actuating rod 71, depending on its position. Set screw 150 sets nut 45 in position on sleeve 120.

Valve stem stop pin 44 can be selectively set longitudinally along axis, C, with respect to mounting head 35, spindle 37, sleeve 120 and plate 134, at one of twelve positions represented by annular groves 160 longitudinally spaced on stop pin 44. By loosening detent 161, which is threaded in the collar of slotted sleeve 120, stop pin 44 can be set to accommodate valve stems of varying lengths. In FIGS. 3–5 stop pin 44 is set in its maximum retracted position to accommodate valve stems of maximum length.

It should be noted that springs 170 are provided to compress collar 171 against spindle drive gear 60, which compresses drive gear 60 against shoulder 172 and collar 172 against thrust shoulder 173 formed on the inside of chuck assembly mounting head 35, shown in FIGS. 3–5. This design insures that spindle 37 is always in the same position along axis, C, of chuck mounting assembly 30 (to the left as viewed in FIGS. 3–5) so that spindle 37 is not moved by the thrust of cylinder 41, which might otherwise occur in the absence of springs 171 due to tolerances. A cap member 175 and seal 176 are held in position by mounting screws 177 to retain collar 171, drive gear 60 and spindle 37 in position in mounting head 35 when sleeve 120 is retracted by the return spring of cylinder 41.

Hood 136 is mounted to rectangular plate 134 by screws 137 to cover plate 131 and move along axis, C, with movement of cylinder actuating rod 71.

Air pressure in the range of 40–80 psi is delivered to pneumatic cylinder 41, the piston on which is sized to yield a thrust on actuating rod 71, plate 134, slotted sleeve 120, collet sleeve 42 and collet 40 along axis, C, in the range of 90–200 pounds. This thrust and the resulting gripping force of collet 40 on valve stem, S, can be infinitely varied by varying the input air pressure. Pneumatic cylinder 41 and the associated pressure and release valves, along with valve stem stop pin 44, provide a quick and efficient means for releasing a ground valve, removing it from chuck assembly 30 and inserting and gripping a new, unground valve, thereby increasing the speed with which numbers of valves can be ground as compared to manually actuated chuck assemblies in prior art devices with grinding wheels.

Actuating valve, switch and regulator unit 70 includes a pressure gauge 180, pressure regulator knob 181 and pressure regulator, valving and switching unit 182, which is controlled by switching post 183. Movement of switching post 183 to the right in FIG. 1 switches the valve (not shown) in unit 182 to vent the cylinder pressure chamber in cylinder 41, thereby allowing the return spring to move the piston and actuating rod 71 to the right releasing the gripping force on valve stem, S. Movement of switching post 183 to the right also switches power from spindle drive motor 50 stopping rotation of valve, V, in chuck spindle 37 of workhead or chuck assembly 30. Switching post 183 is spring loaded to move leftwardly, in which position the valve and switch in switching unit 182 energize spindle motor 50 and actuate cylinder 41, respectively.

Operation

The invention operates to grind the frusto-conical valve face, F, of valves, V, and provide for automatic seating and gripping of valve stem, S, in chuck assembly 30, and to provide for adjustment of the seated position and gripping force of collet 40 on valve stem, S, and efficient automatic release of ground valves to allow grinding of another valve, as follows.

The grinding operation begins with the workhead or chuck assembly 30 in its extreme position of movement to the right along axis, X. Chuck assembly 30 is pushed to this position by manual force to the right on knob 31. In this position, the right edge of the slidable base on which chuck assembly mounting head 35 is mounted engages switching post 183, pushing it to the right, switching power from spindle drive motor 50 and venting the pressure chamber of cylinder 41. In this position spindle 37 is not rotating and collet 40 is relaxed. It should be noted that switching post 183 serves as a stop against further movement to the right of chuck assembly 30.

Valve stop pin 44 is manually set in the desired position to provide for proper seating of valve, V, in chuck assembly 30, depending on valve stem length, by loosening threaded detent 161 and selectively setting pin 44 along axis, C, with detent 161 in one of the twelve annular grooves 160. Threaded detent 161 is tightened.

Chuck assembly mounting head 35 is set in the selected position about axis, Z, for the angle of the valve face to be ground.

Air pressure regulator knob is set at the selected air pressure and adjusting nut 45 is set at the desired location.

An unground valve is then inserted into collet 40 with the end of valve stem, S, abutting the left end of valve stem stop pin 44. Workhead or chuck assembly 30 is then moved to the left by manual force on knob 31 thereby releasing switching post 183. The release of post 183 energizes spindle drive motor 50 and actuates cylinder 41, thereby pushing sleeve 120 and valve stem stop pin 44 to the left. This leftward movement, shown progressively in FIGS. 3–5, pushes slotted sleeve 120, collet sleeve 42 and collet 40 to the left in spindle 37, thereby causing collet 40 to grip valve stem, S.

The drive motor 12 is energized driving abrasive belt 16.

Workhead or chuck assembly 30 is then moved further to the left along axis, X, and moved along axis, Y, forwardly or rearwardly, by operation of wheel 32, to accurately position valve face, F, into grinding position against abrasive belt 16 and backing wheel 14, to grind valve, V, as it rotates in spindle 37.

When the valve is ground, workhead or chuck assembly 30 is moved to the right to stop against switching post 183, thereby stopping spindle drive motor 50 and venting cylinder 41. The ground valve, V, stops rotating, is automatically released from the grip of collet 40 and can be removed so a new valve can be inserted and the process repeated.

Throughout the grinding operation, oil is discharged into the grinding interface between belt 16 and valve face,F, collected, filtered, cooled and recirculated by grinding oil system 90.

The invention thus provides a more efficient and economical apparatus for valve grinding, allowing grinding of 200–500 valves per belt change and allowing grinding of two valves per minute, a substantial improvement over prior art devices.

Having thus described the preferred embodiment of the invention, the following is claimed:

1. Apparatus for grinding a valve member having a head, a stem, a stem axis and a frusto-conical valve on the valve head, which comprises:

a. a base;

b. a generally cylindrical drive wheel mounted to the base for rotation about a first axis;

c. a generally cylindrical backing wheel mounted to the base for rotation about a second axis spaced from and parallel to the first axis;

d. an endless abrasive belt extending around the drive wheel and the backing wheel in engagement with the generally cylindrical surfaces thereof;

e. drive means for rotating the drive wheel about the first axis;

f. chuck means mounted to the base for gripping the valve stem, said chuck means including a collet for gripping the valve stem and a sleeve for compressing the collet, against the valve stem and stop means for abutting the chuck means thereby limiting movement of the sleeve and compression of the collet on the valve stem, and means for axially adjusting the stop means along the sleeve axis to thereby adjust the gripping force of the collet on the stem;

g. means for rotating the chuck means to thereby rotate the valve about the stem axis; and h. means for moving the valve face into engagement with the endless abrasive belt during rotation of the valve and movement of the belt, to thereby grind the valve face.

2. The apparatus of claim 1 wherein the chuck means for gripping the valve about its stem is pneumatically actuated for gripping and release of the valve stem.

3. The apparatus of claim 2 wherein the chuck means for gripping and release of the valve stem comprises:

a. a spindle mounted for rotation about the stem axis;

b. a collet co-axially mounted in the spindle for rotation therewith;

c. a pneumatic cylinder with an actuating rod mounted for stroke movement along the stem axis; and d. sleeve means disposed in the spindle for movement along the stem axis with movement of the actuating rod for engaging the collet to cause the collet to grip the valve stem.

4. The apparatus of claim 3 and valve stem stop means mounted co-axially in the sleeve means for engaging the end of the valve stem, and means for adjusting the position of the valve stem stop means along its axis relative to the collet, to thereby selectively position the valve in the chuck means.

5. The apparatus of claim 1 wherein the endless abrasive belt is driven by the drive wheel at a lineal speed in the range of 6000–7500 feet per minute.

6. The apparatus of claim 1 wherein the valve stem is rotated about the stem axis at a speed in the range of 10–200 rpm.

7. The apparatus of claim 1 wherein the chuck means for gripping the valve about its stem further comprises:

a. a chuck assembly mounting head mounted to the base for pivotal movement about a vertical axis and for sliding movement in a horizontal plane along an axis parallel to the first and second axes and along an axis perpendicular to the first and second axes;

b. a spindle mounted in the chuck assembly mounting head for rotation about a horizontal spindle axis;

c. a valve stem stop pin mounted co-axially in the sleeve for engaging the valve stem end;

d. means for selectively adjusting the valve stem stop pin with relation to the collet to thereby position the valve in the collet;

e. means for rotating the spindle, collet, sleeve, stop means and valve stem stop pin about the spindle axis; and f. pneumatically actuated means for compressing the sleeve coaxially against the collet to thereby cause the collet to grip the valve stem.

8. The apparatus of claim 7 wherein the pneumatically actuated means comprises:

a. a pneumatic cylinder mounted to the chuck assembly mounting head with an actuating rod mounted for stroke movement along a stroke axis spaced from and parallel to the spindle axis; and b. means connecting the actuating rod to the sleeve to cause compression of the sleeve against the collet to thereby grip the valve stem when pressure is applied to the pneumatic cylinder.

9. The apparatus of claim 8 and pressure regulating means for regulating the pressure in the cylinder.

10. The apparatus of claim 9 wherein the endless belt is driven by the drive wheel at a lineal speed in the range of 6000–7500 feet per minute.

11. The apparatus of claim 10 wherein the valve stem is rotated at a speed in the range of 10–200 rpm.

* * * * *